US010109408B2

(12) United States Patent
Hsiao et al.

(10) Patent No.: US 10,109,408 B2
(45) **Date of Patent: *Oct. 23, 2018**

(54) MAGNETIC PATTERNED WAFER USED FOR PRODUCTION OF MAGNETIC-CORE-INDUCTOR CHIP BODIES AND METHODS OF MAKING THE SAME

(71) Applicant: Wafer Mems Co., LTD., Miaoli County (TW)

(72) Inventors: Min-Ho Hsiao, Miaoli County (TW); Pang-Yen Lee, Miaoli County (TW); Yen-Hao Tseng, Miaoli County (TW)

(73) Assignee: WAFER MEMS CO., LTD., Miaoli County (TW)

( * ) Notice: Subject to any disclaimer, the term of this patent is extended or adjusted under 35 U.S.C. 154(b) by 75 days.

This patent is subject to a terminal disclaimer.

(21) Appl. No.: 15/152,804

(22) Filed: May 12, 2016

(65) Prior Publication Data

US 2016/0379745 A1 Dec. 29, 2016

(30) Foreign Application Priority Data

Jun. 25, 2015 (TW) ..... 104120522 A

(51) Int. Cl.

| | |
|---|---|
| ***B44C 1/22*** | (2006.01) |
| ***H01F 27/24*** | (2006.01) |
| ***H01F 41/02*** | (2006.01) |
| ***H01F 27/28*** | (2006.01) |
| ***H01F 41/04*** | (2006.01) |
| ***H01F 3/08*** | (2006.01) |
| ***H01F 17/04*** | (2006.01) |

(52) U.S. Cl.

CPC ..... *H01F 27/24* (2013.01); *H01F 3/08* (2013.01); *H01F 17/04* (2013.01); *H01F 27/2804* (2013.01); *H01F 41/02* (2013.01); *H01F 41/0206* (2013.01); *H01F 41/041* (2013.01)

(58) Field of Classification Search

CPC ... H01L 21/705; H01L 27/016; H01L 27/222; H01F 17/04; H01F 41/0206

USPC ..... 216/22, 54, 74, 75

See application file for complete search history.

(56) References Cited

U.S. PATENT DOCUMENTS

| | | | | |
|---|---|---|---|---|
| 2011/0175195 | A1* | 7/2011 | Lin | H01L 21/6835 257/531 |
| 2015/0136467 | A1* | 5/2015 | Rathburn | H05K 3/326 174/261 |
| 2015/0270053 | A1* | 9/2015 | Cha | C25D 7/001 336/192 |

(Continued)

*Primary Examiner* — Binh X Tran

(74) *Attorney, Agent, or Firm* — Womble Bond Dickinson (US) LLP

(57) ABSTRACT

A magnetic patterned wafer used for production of magnetic-core-inductor chip bodies includes a peripheral end portion and at least one core chip unit that including a connecting portion, a breaking line, and a plurality of spaced apart chip bodies. The connecting portion is connected to the peripheral end portion and is spaced apart from the chip bodies by a tab-accommodating space. The breaking line has a plurality of connecting tabs that are spaced apart from one another and that are disposed in the tab-accommodating space. Each of the connecting tabs interconnects the connecting portion and a respective one of the chip bodies. The patterned wafer is made from a magnetic material.

9 Claims, 24 Drawing Sheets

(56) References Cited

U.S. PATENT DOCUMENTS

2015/0338643 A1* 11/2015 Erlich ..... G02B 26/085
438/458
2015/0348936 A1* 12/2015 Lin ..... H01L 23/552
257/659
2016/0126010 A1* 5/2016 Wang ..... H05B 33/0803
315/185 R
2016/0379749 A1* 12/2016 Hsiao ..... H01F 17/0033
336/200
2016/0379969 A1* 12/2016 Hsiao ..... H01L 21/705
438/381

* cited by examiner

MAGNETIC PATTERNED WAFER USED FOR PRODUCTION OF MAGNETIC-CORE-INDUCTOR CHIP BODIES AND METHODS OF MAKING THE SAME

CROSS-REFERENCE TO RELATED APPLICATION

This application claims priority of Taiwanese Application No. 104120522, filed on Jun. 25, 2015.

FIELD

The disclosure relates to a magnetic patterned wafer and a method of making the same, more particularly to a magnetic patterned wafer used for production of magnetic-core-inductor chip bodies.

BACKGROUND

There are three types of inductors, namely thin film type inductors, multilayered type inductors, and wire wound type inductors, which are commercially available.

TW patent application publication No. 201440090 A discloses a multilayered type inductor (see FIG. 1) and a method of making the same.

The method of making the multilayered type inductor includes the steps of: laminating a first circuit plate 110, a second circuit plate 120, a third circuit plate 130 and a fourth circuit plate 140 (see FIG. 2A); attaching an assembly of a supporting film 150 and a bonding pad circuit 160 to the first circuit plate 110 (see FIG. 2B); transferring the bonding pad circuit 160 from the supporting film 150 to the first circuit plate 110 (see FIG. 2C); removing the supporting film 150 from the bonding pad circuit 160 (see FIG. 2D); sintering the first, second, third and fourth circuit plates 110, 120, 130, 140 and the bonding pad circuit 160 so as to form a multilayered substrate 100 (see FIG. 2E); and scribing the multilayered substrate 100 using a scriber 170 (see FIG. 2F), so that the multilayered substrate 100 can be broken into a plurality of multilayered type inductors 10 (see FIG. 1).

Referring to FIG. 1, each of the first, second, third and fourth circuit plates 110, 120, 130, 140 includes a respective one of non-magnetic bodies 111, 121, 131, 141 and a respective one of first, second, third and fourth circuit patterns 112, 122, 132, 142. Formation of the first, second, third and fourth circuit plates 110, 120, 130, 140 requires numerous steps (a total of at least 13 steps), including punching each non-magnetic body 111, 121, 131, 141 to form the holes, filling the conductive paste in the holes, and forming the first, second, third and fourth circuit patterns 112, 122, 132, 142, and sintering before laminating the first, second, third and fourth circuit plates 110, 120, 130, 140.

The aforesaid method is relatively complicate, and the bonding strength between the first, second, third and fourth circuit patterns 112, 122, 132, 142 may be insufficient. There is still a need to simplify both the structure of the multilayered type inductor and the method of making the same.

SUMMARY

Therefore, an object of the disclosure is to provide a magnetic patterned wafer used for production of magnetic-core-inductor chip bodies that can alleviates the drawback of the prior art.

Another object of the disclosure is to provide a method of making a magnetic patterned wafer that can alleviate the drawback of the prior art and that is relatively simple.

According to one aspect of the disclosure, there is provided a magnetic patterned wafer used for production of magnetic-core-inductor chip bodies. The magnetic patterned wafer includes a peripheral end portion and at least one core chip unit that includes a connecting portion, a breaking line, and a plurality of spaced apart chip bodies.

The connecting portion is connected to the peripheral end portion and is spaced apart from the chip bodies by a tab-accommodating space along a direction. The breaking line has a plurality of connecting tabs that are spaced apart from one another and that are disposed in the tab-accommodating space.

Each of the connecting tabs interconnects the connecting portion and a respective one of the chip bodies.

The patterned wafer is made from a magnetic material.

According to another aspect of the disclosure, there is provided a method of making a magnetic patterned wafer that is used for production of magnetic-core-inductor chip bodies. The method includes:

forming at least one patterned photoresist layer on a magnetic wafer such that the magnetic wafer has an etched portion exposed from the patterned photoresist layer, the patterned photoresist layer having a peripheral end part and at least one core-defining unit, the core-defining unit having a connecting part, a plurality of breaking-line-defining protrusions, and a plurality of chip-defining parts;

etching the etched portion so as to pattern the wafer; and removing the patterned photoresist layer from the patterned wafer, such that the patterned wafer has a peripheral end portion and at least one core chip unit that includes a connecting portion, a breaking line, and a plurality of spaced apart chip bodies, the connecting portion being connected to the peripheral end portion, the breaking line having a plurality of connecting tabs that are spaced apart from one another, each of the connecting tabs being disposed between and interconnecting the connecting portion and a respective one of the chip bodies.

According to yet another aspect of the disclosure, there is provided a method of making a magnetic patterned wafer. The method includes:

providing a punching die having a plurality of die holes that are arranged in an array; and punching the magnetic wafer using the punching die so as to form a magnetic patterned wafer that has a peripheral end portion and at least one core chip unit, the core chip unit including a connecting portion, a breaking line, and a plurality of spaced apart chip bodies, the connecting portion being connected to the peripheral end portion and being spaced apart from the chip bodies by a tab-accommodating space along a direction, the breaking line having a plurality of connecting tabs that are spaced apart from one another and that are disposed in the tab-accommodating space;

wherein each of the connecting tabs interconnects the connecting portion and a respective one of the chip bodies.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
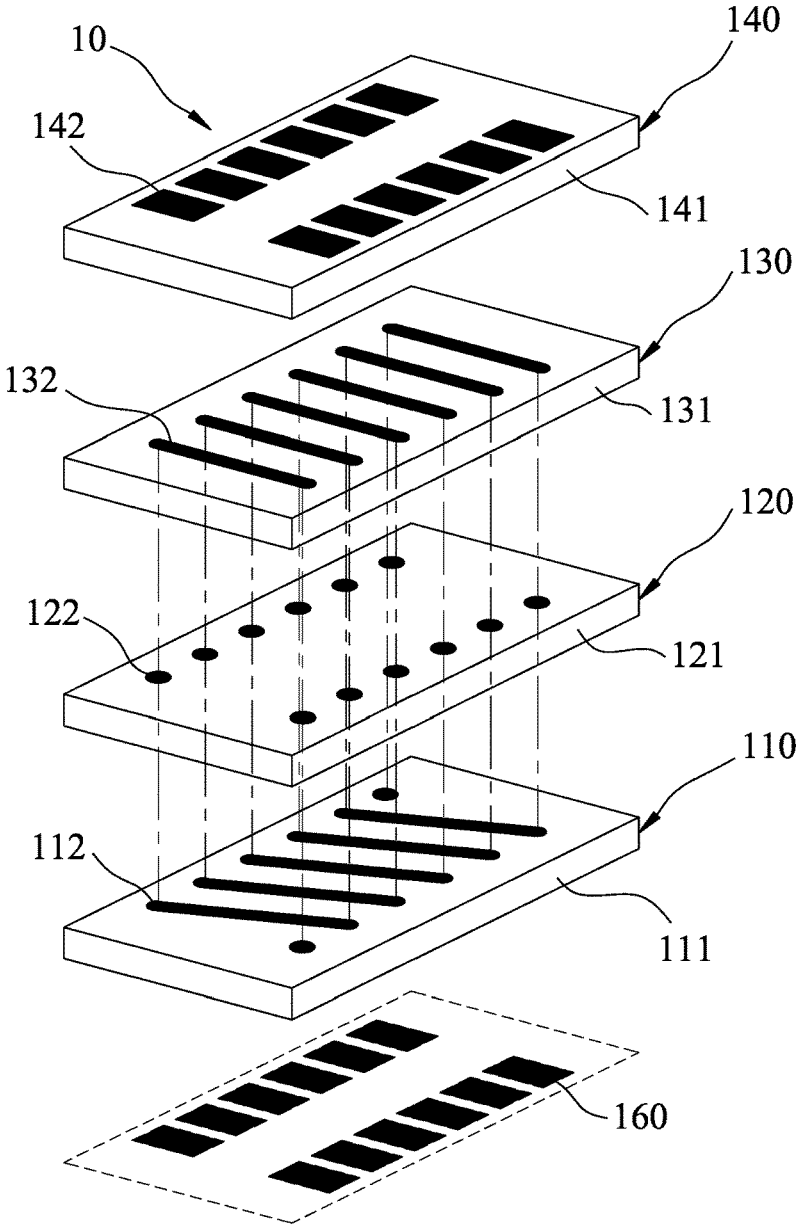
FIG.1 PRIOR ART
FIG. 1 is an exploded perspective view of a multilayered type inductor disclosed in TW patent application publication No. 201440090 A.
Figure 2A:
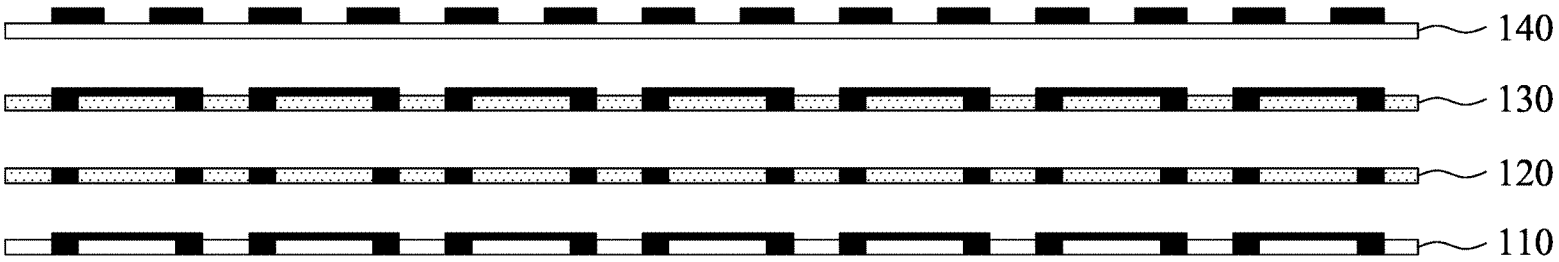
FIG.2A PRIOR ART
FIGS. 2A to 2F are sectional views illustrating consecutive steps of a method of making the multilayered type inductor of FIG. 1.
Figure 2B:
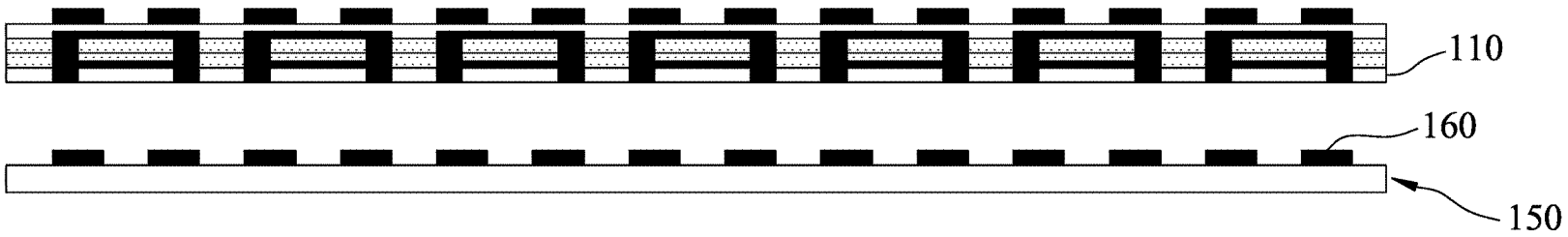
FIG.2B PRIOR ART
Figure 2C:
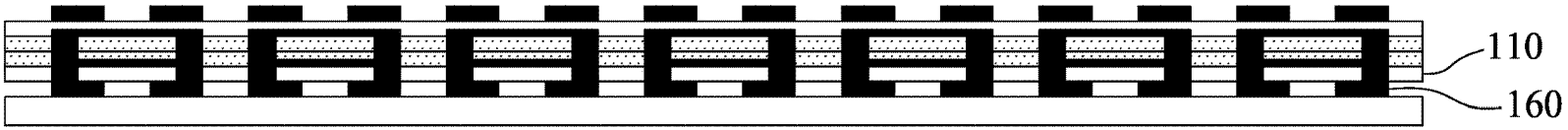
FIG.2C PRIOR ART
Figure 2D:
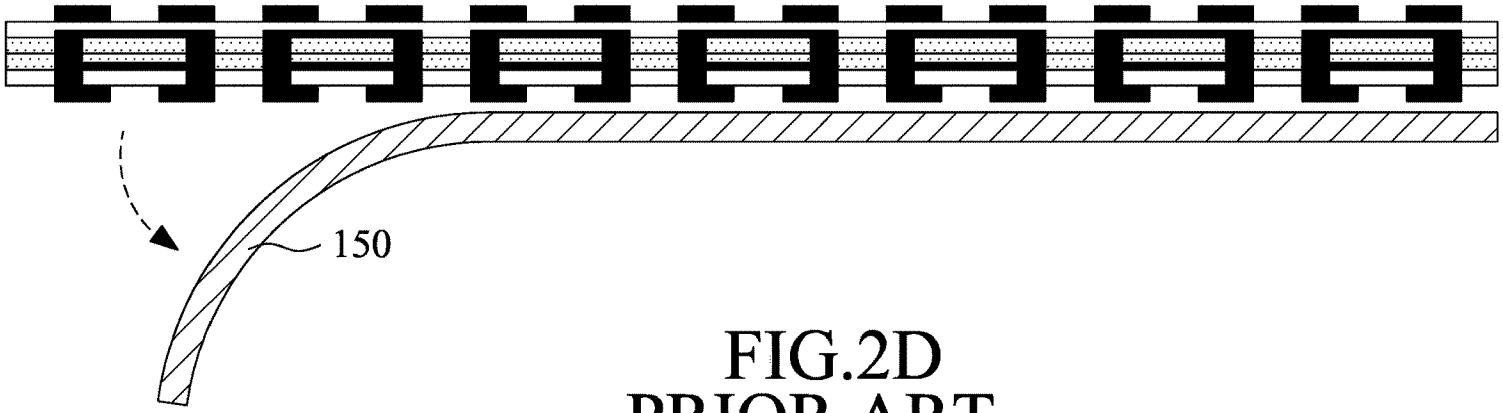
FIG.2D PRIOR ART
Figure 2E:
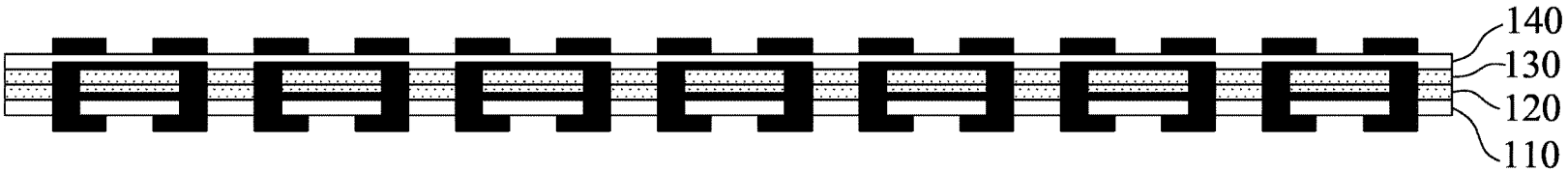
FIG.2E PRIOR ART
Figure 2F:
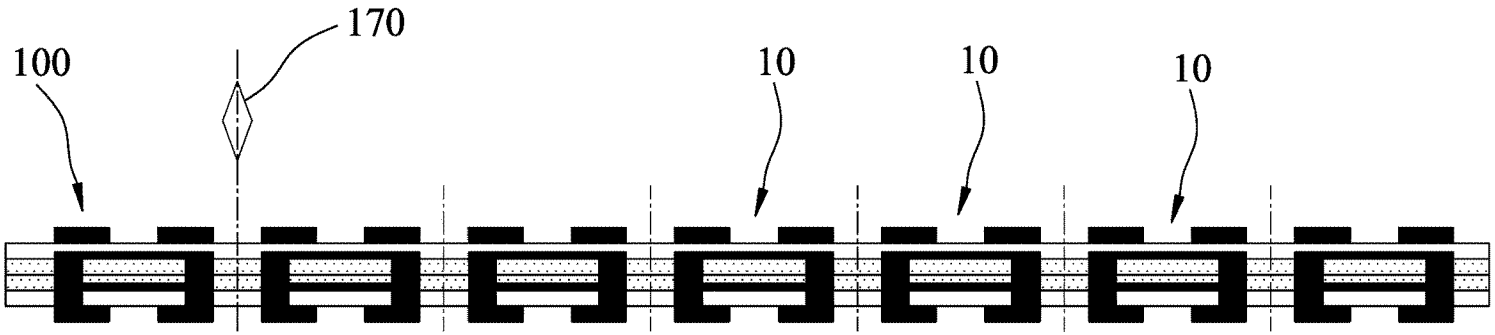
FIG.2F PRIOR ART

It may be noted that like elements are denoted by the same reference numerals throughout the disclosure.

Figure 3:
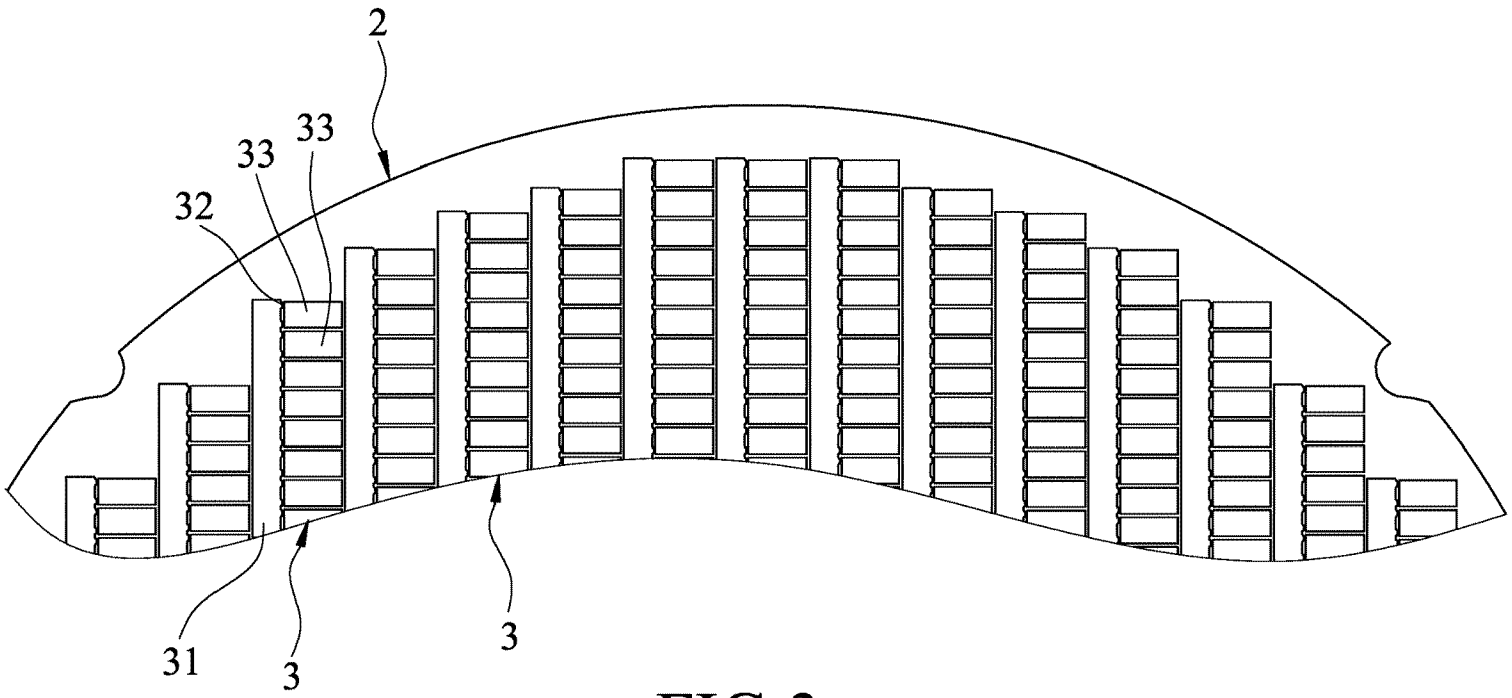
FIG. 3 is a fragmentary top view illustrating the first embodiment of a magnetic patterned wafer according to the disclosure.
Figure 4:
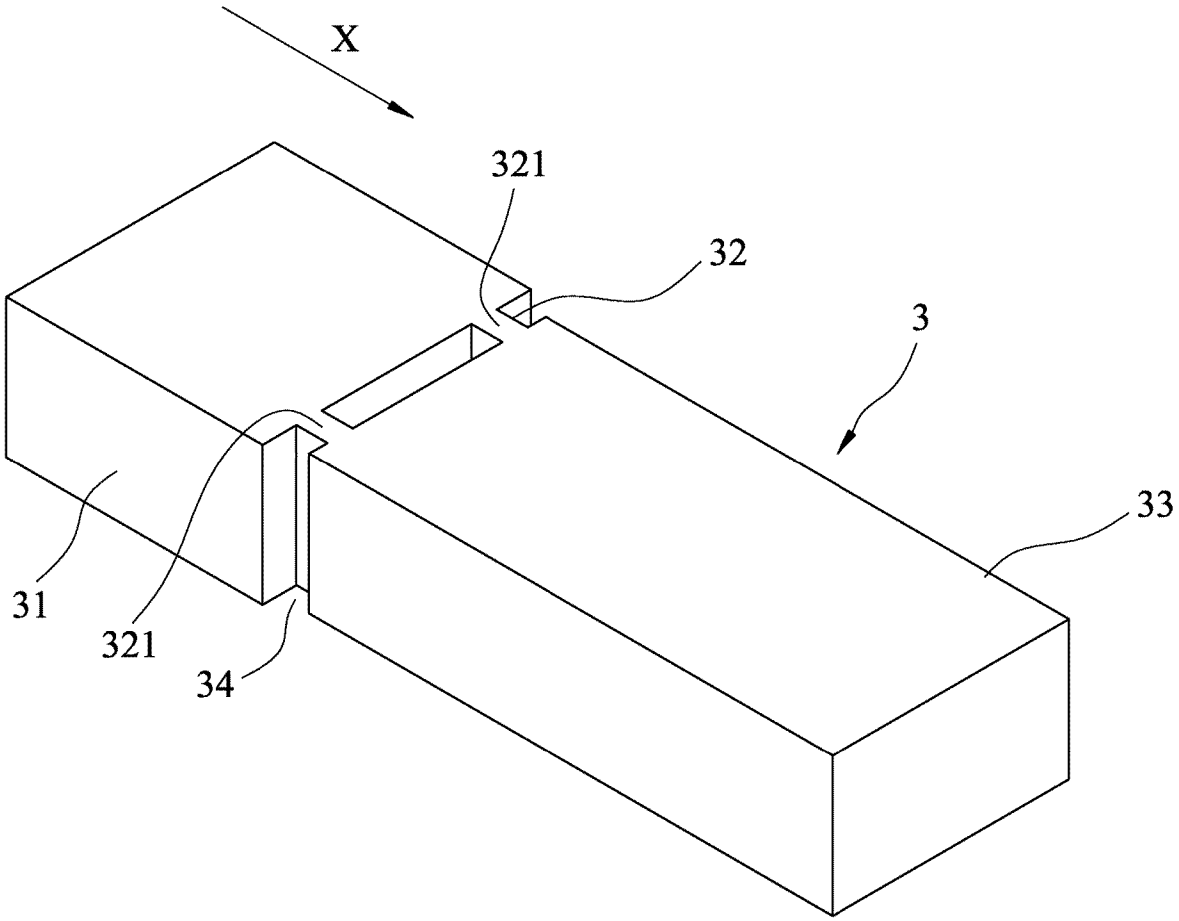
FIG. 4 is a perspective view illustrating a core chip unit included in the first embodiment.

FIGS. 3 and 4 illustrate the first embodiment of a magnetic patterned wafer used for production of magnetic-core-inductor chip bodies according to the disclosure. The magnetic patterned wafer comprises a peripheral end portion 2 and at least one core chip unit 3 that includes a connecting portion 31, a breaking line 32, and a plurality of spaced apart chip bodies 33. Since the peripheral end portion 2 and the core chip unit 3 are in the form of a single piece, the structural strength of the magnetic patterned wafer is relatively high, which permits alleviating the drawback of the prior art in the structural strength.

The connecting portion 31 is connected to the peripheral end portion 2, and is spaced apart from the chip bodies 33 by a tab-accommodating space 34 along a first direction X. The breaking line 32 has a plurality of connecting tabs 321 that are spaced apart from one another and that are disposed in the tab-accommodating space 34. Each of the connecting tabs 321 interconnects the connecting portion 31 and a corresponding one of the chip bodies 33. In this embodiment, two of the connecting tabs 321 interconnect the connecting portion 31 and the corresponding one of the chip bodies 33.

Figure 5:
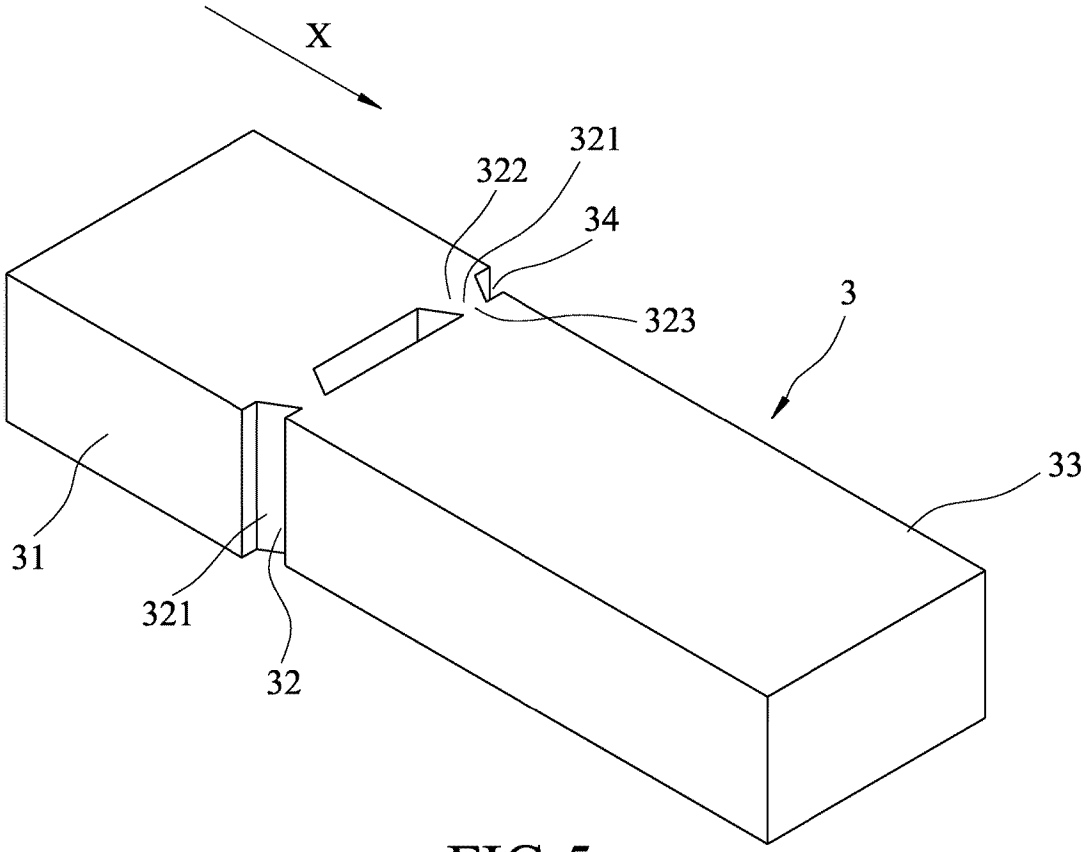
FIG. 5 is a perspective view illustrating a core chip unit included in the second embodiment of a magnetic patterned wafer according to the disclosure.

FIG. 5 illustrates the second embodiment of a magnetic patterned wafer according to the disclosure. The magnetic patterned wafer of the second embodiment is similar to the first embodiment, except that each of the connecting tabs 321 has a first end 322 connected to the connecting portion 31 and a second end 323 connected to the corresponding one of the chip bodies 33, and is reduced in width from the first end 322 toward the second end 323 along the first direction (X).

Figure 6:
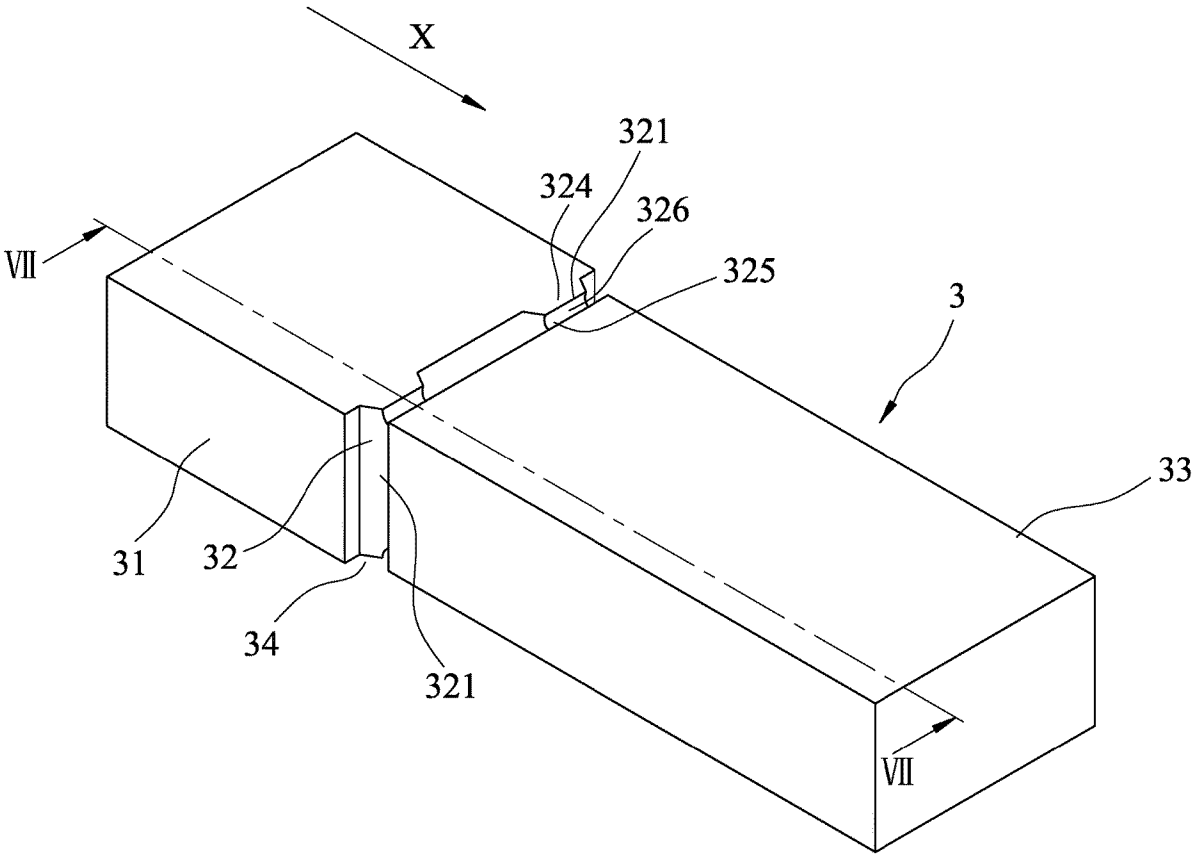
FIG. 6 is a perspective view illustrating a core chip unit included in the third embodiment of a magnetic patterned wafer according to the disclosure.
Figure 7:
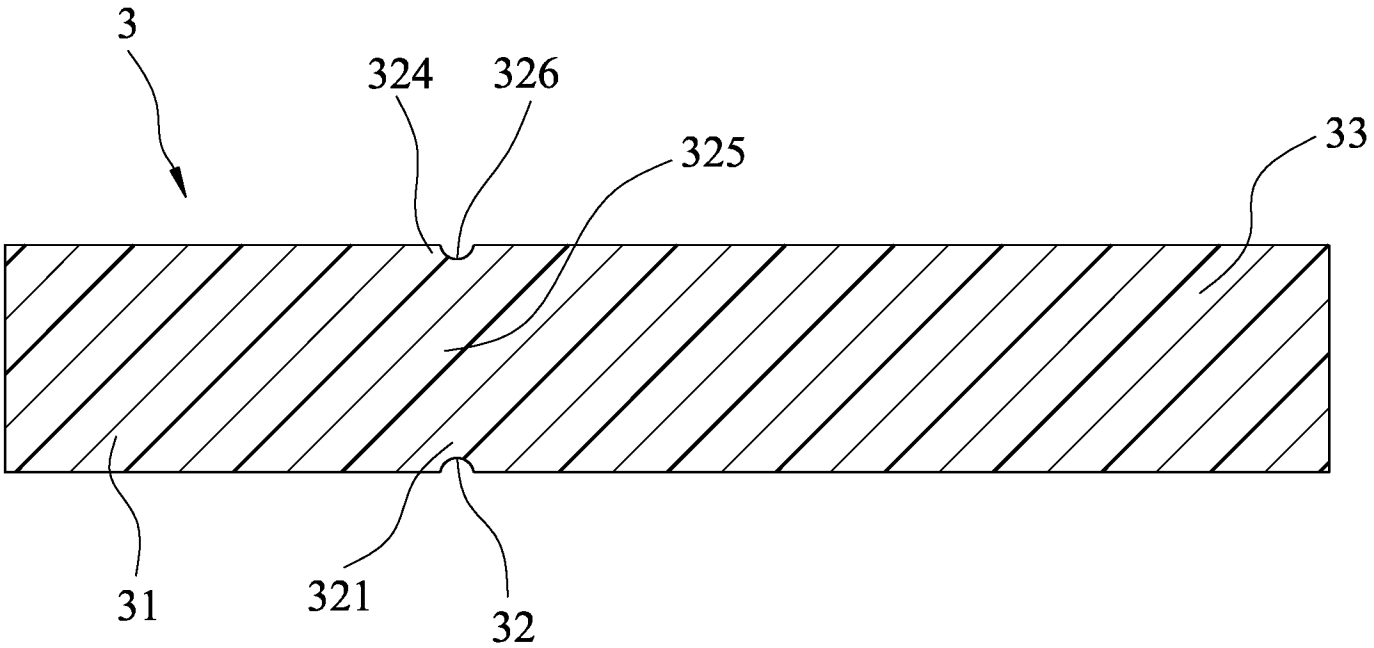
FIG. 7 is a sectional view taken along lines VII-VII of FIG. 6.

FIGS. 6 and 7 illustrate the third embodiment of a magnetic patterned wafer according to the disclosure. The magnetic patterned wafer of the third embodiment is similar to the first embodiment, except that each of the connecting tabs 321 has a base segment 324 that protrudes from the connecting portion 31 in the first direction (X), and a neck segment 325 that extends in the first direction (X) from the base segment 324 to the corresponding one of the chip bodies 33 and that cooperates with the base segment 324 and the corresponding one of the chip bodies 23 to define at least one recess 326 thereamong. In certain embodiment, the base segment 324 is reduced in width from the first end 322 toward the second end 323 along the first direction (X).

In certain embodiments, the magnetic patterned wafer is made from a magnetic metal material or a magnetic ceramic material. The magnetic metal material is selected from the group consisting of iron (Fe), cobalt (Co), and nickel (Ni). The magnetic ceramic material is, e.g., ferrite ($Fe_3O_4$) with an inverse spinel structure.

It is noted that the production of magnetic patterned wafer of the disclosure may use MEMS manufacturing techniques. Each of the magnetic-core-inductor chip bodies made from the magnetic patterned wafer of the disclosure may be formed with a circuit thereon.

Figure 8:
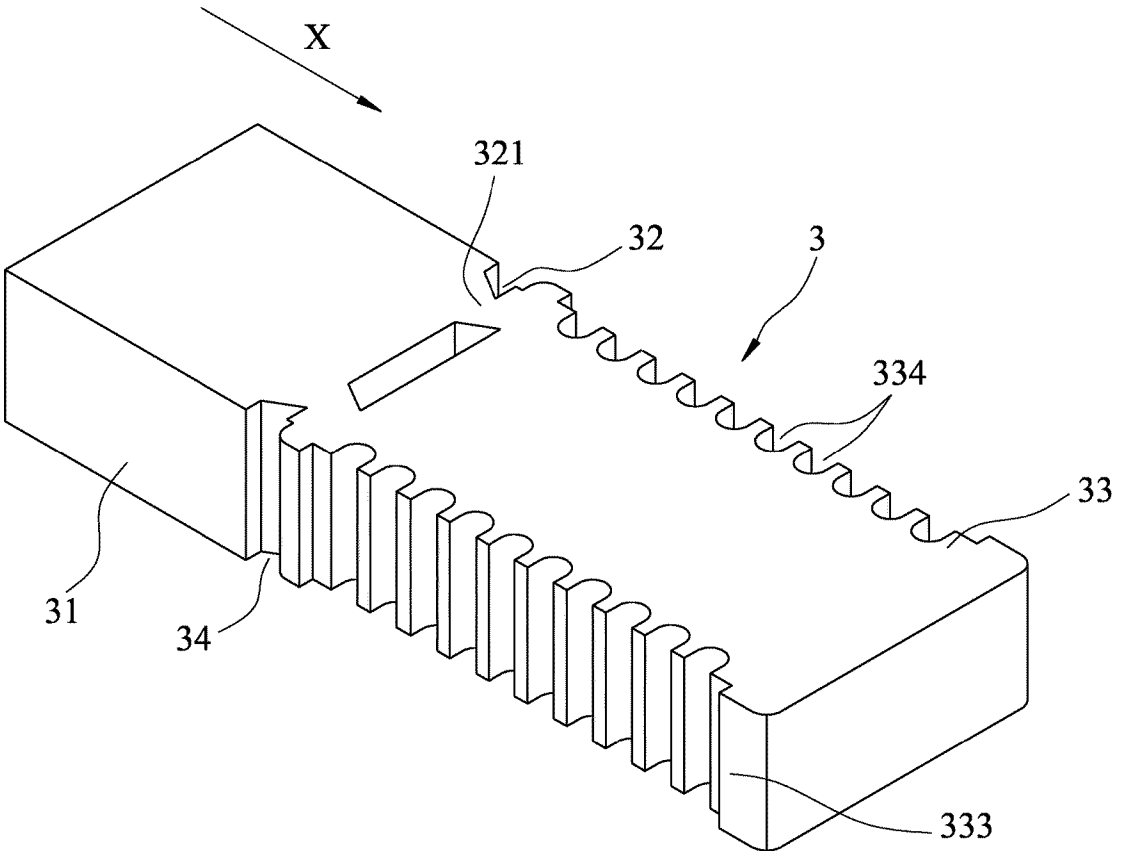
FIG. 8 is a perspective view illustrating a core chip unit included in the fourth embodiment of a magnetic patterned wafer according to the disclosure.

Referring to FIG. 8, a fourth embodiment of the magnetic patterned wafer according to the disclosure differs from the second embodiment in that each of the chip bodies 33 of the fourth embodiment further includes a plurality of spaced apart notches 334 that are indented inwardly from side surfaces 333 of the chip body 33. A coil (not shown) may extend into and through the notches 334 in the chip body 33 so as to form a coil-type inductor.

Figure 9:
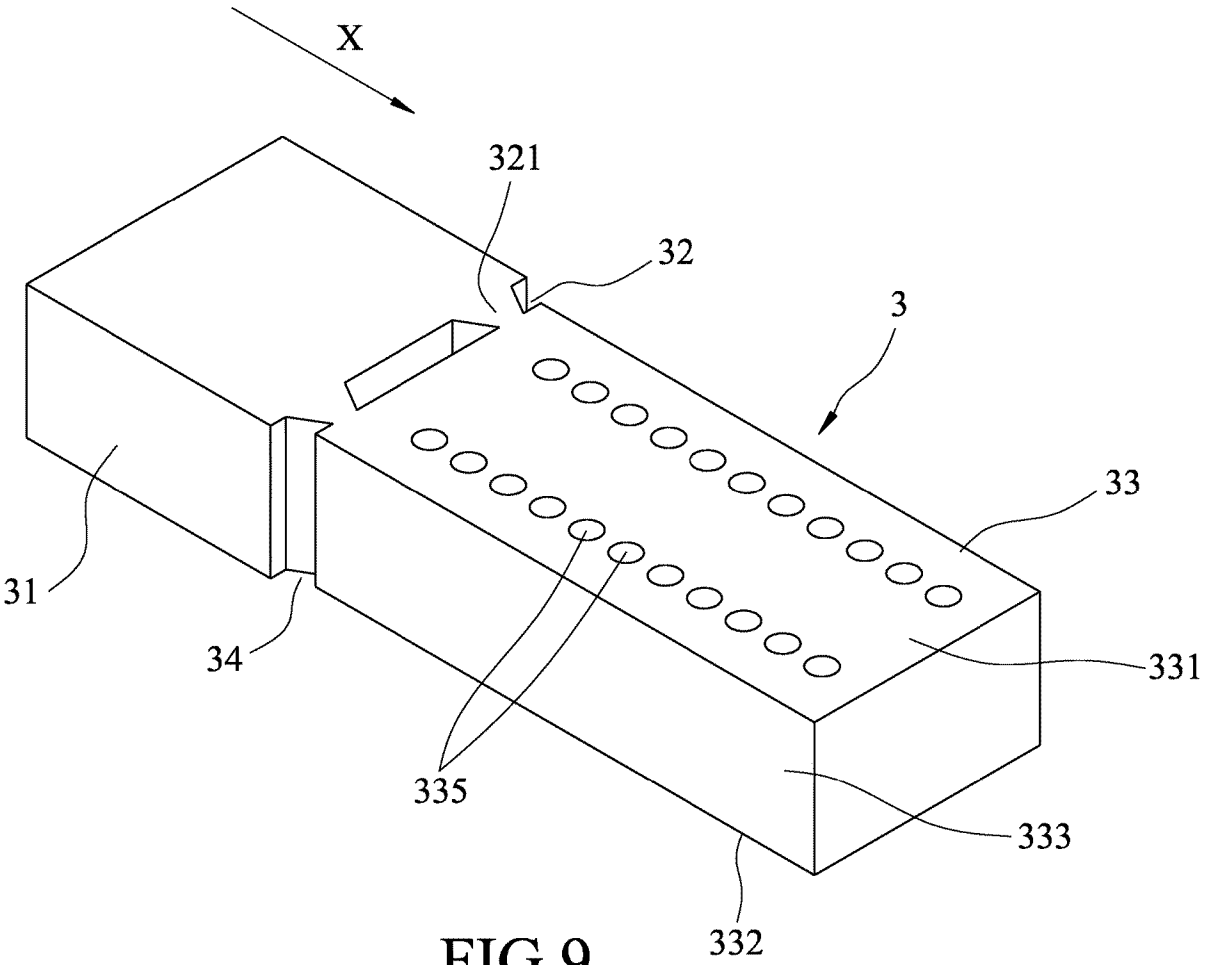
FIG. 9 is a perspective view illustrating a core chip unit included in the fifth embodiment of a magnetic patterned wafer according to the disclosure.

Referring to FIG. 9, a fifth embodiment of the magnetic patterned wafer according to the disclosure differs from the second embodiment in that each of the chip bodies 33 of the fifth embodiment further includes a plurality of spaced apart holes 335 that extend through a top surface 331 and a bottom surface 332 of the chip body 33 and that are disposed between the side surfaces 333. In a similar manner, a coil (not shown) may extend into and through the holes 335 in the chip body so as to form a coil-type inductor.

The following description illustrates a method of making the magnetic patterned wafer of the embodiment of the disclosure, and should not be construed as limiting the scope of the disclosure. The method includes the steps of S1 to S4.

Figure 10:
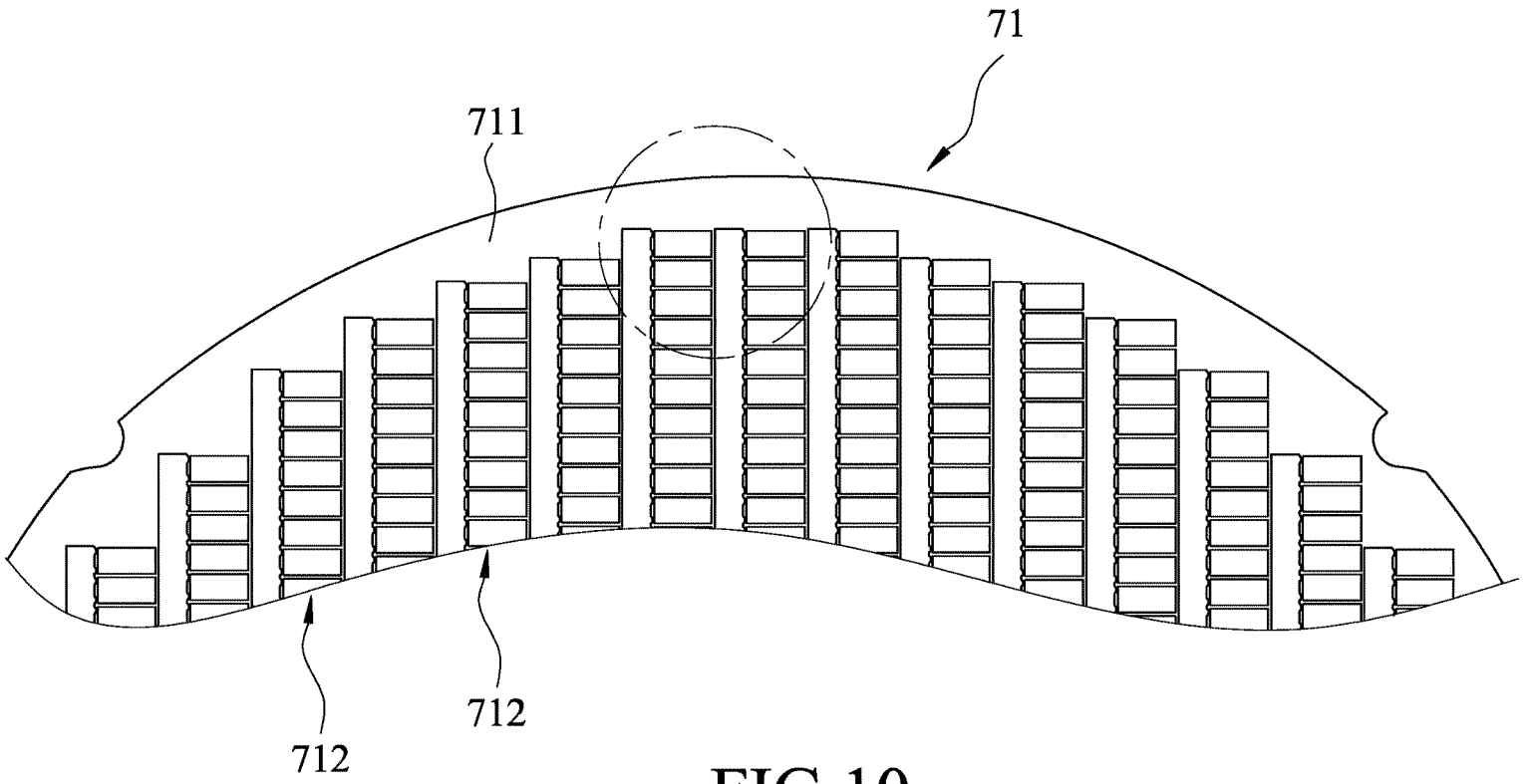
FIG. 10 is a fragmentary top view illustrating a patterned photoresist layer used in step S1 of a method of making the magnetic patterned wafer according to the disclosure.

In step S1 (see FIGS. 10, 11 and 12), at least one patterned photoresist layers 71 is formed on a magnetic wafer 60, such that the magnetic wafer 60 has an etched portion 600 exposed from the patterned photoresist layer 71, the patterned photoresist layer 71 having a peripheral end part 711 and at least one core-defining unit 712, the core-defining unit 712 having a connecting part 7121, a plurality of breaking-line-defining protrusions 7122, and a plurality of chip-defining parts 7123.

Figure 13:
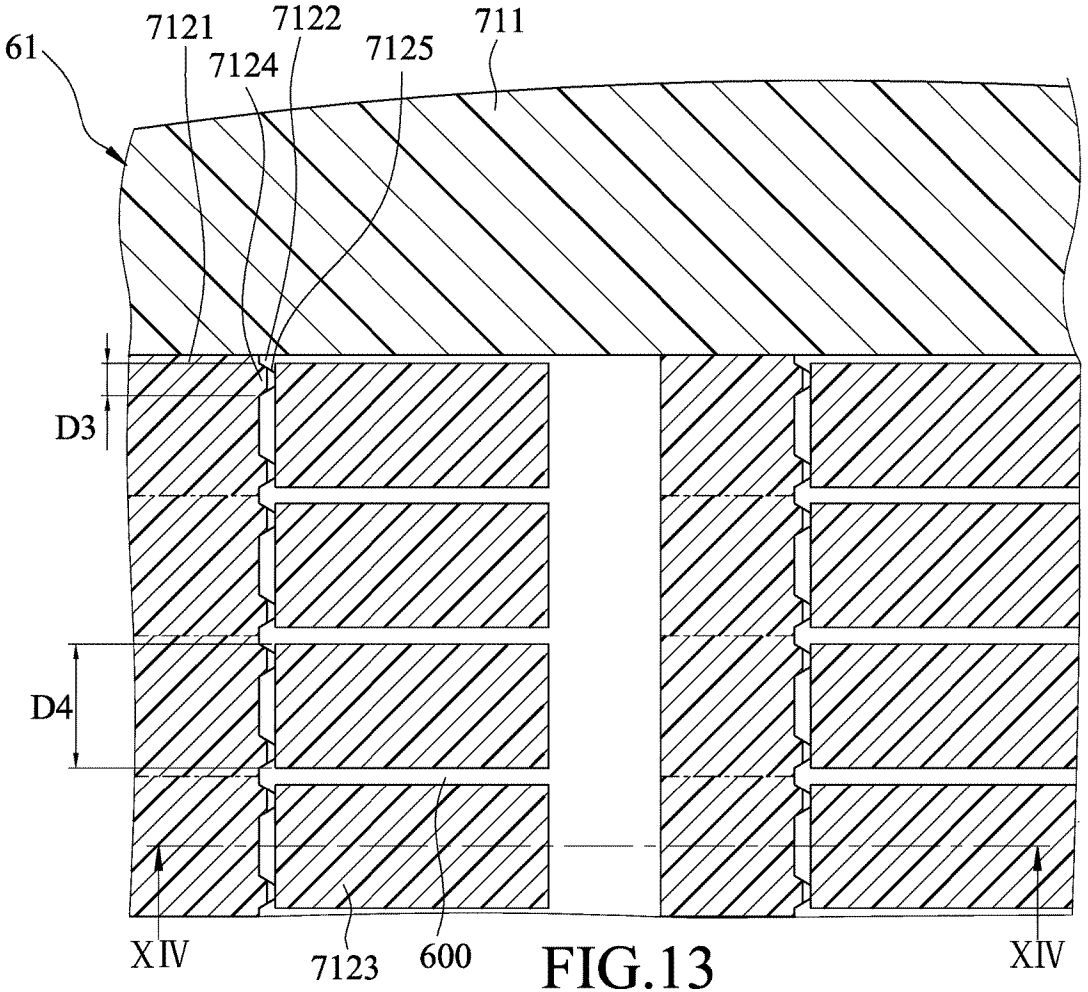
FIG. 13 is a fragmentary top view illustrating step S2 of the method of making a magnetic patterned wafer according to the disclosure.

Moreover, as shown in FIG. 13, each of the breaking-line-defining protrusions 7122 is aligned with a respective one of the chip-defining parts 7123 in a first direction (X) and having a width (D3) smaller than that (D4) of the respective one of the chip-defining parts 7123 in a second direction (Y) that is perpendicular to the first direction (X).

Figure 14:
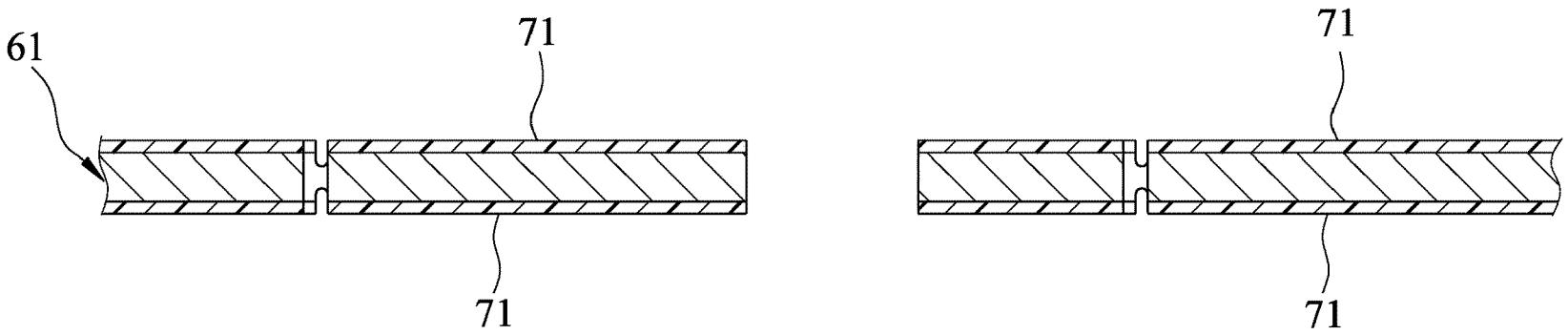
FIG. 14 is a sectional view taken along line XIV-XIV of FIG. 13.

In certain embodiment, the magnetic wafer 60 has top and bottom surfaces 603, 604, each of which is formed with the patterned photoresist layer 71, and the patterned photoresist layers 71 formed on the top and bottom surfaces are symmetrical to each other (see FIG. 14).

It should be noted that each of the breaking-line-defining protrusions 7122 may be connected to or spaced apart from a respective one of the chip-defining parts 7123.

Figure 11:
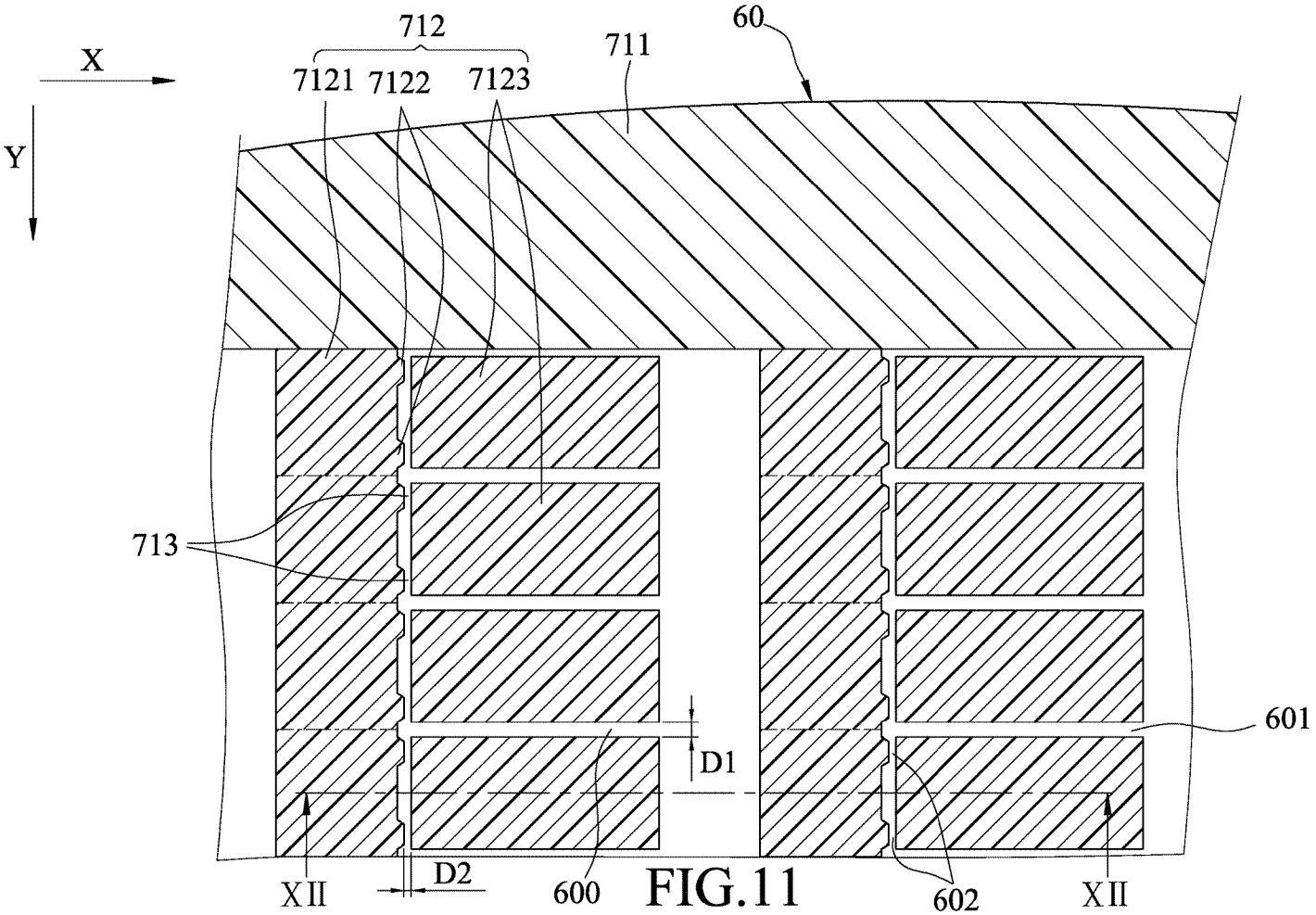
FIG. 11 is an enlarge view of an encircled portion in FIG. 10.
Figure 12:
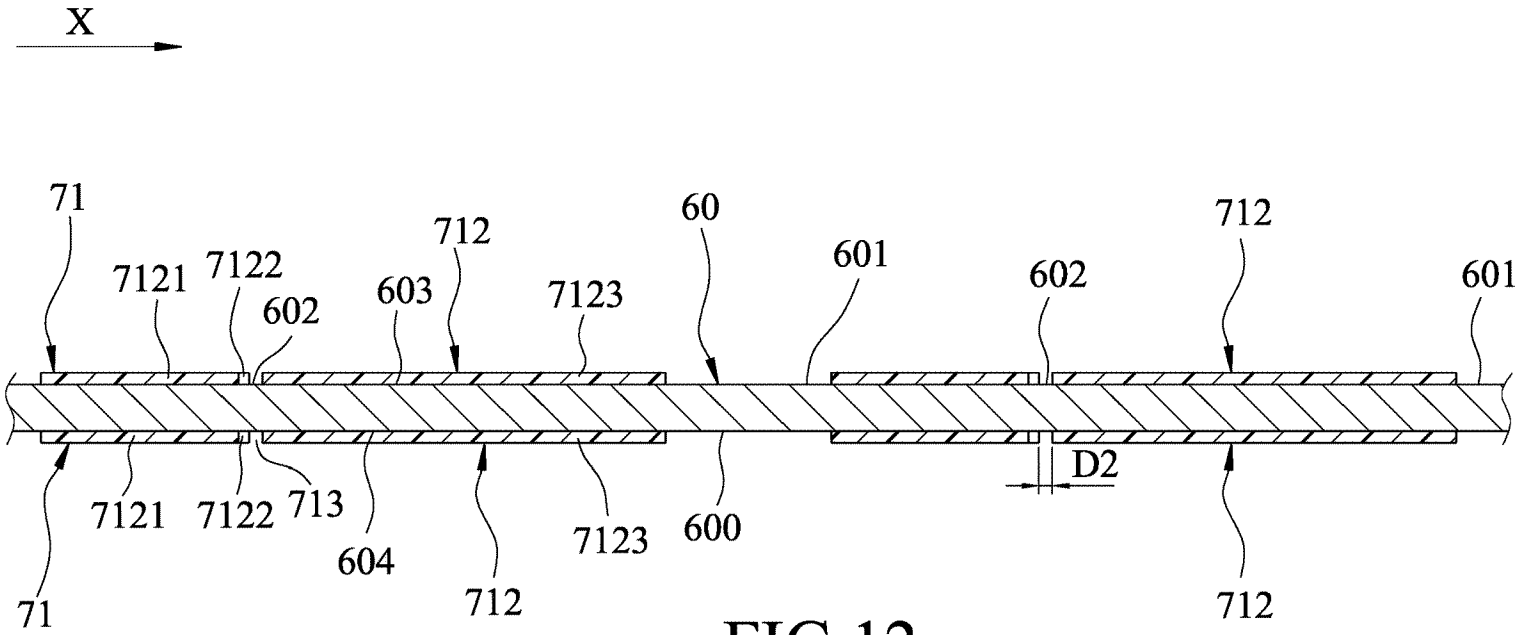
FIG. 12 is a sectional view taken along lines XII-XII of FIG. 11.

As shown in FIG. 11, in this embodiment, each of the breaking-line-defining protrusions 7122 is spaced apart from a respective one of the chip-defining parts 7123. As such, the etched portion 600 of the magnetic wafer 60 is designed to have a plurality of to-be-fully-etched regions 601 that are exposed from the respective patterned photoresist layer 71, and a plurality of to-be-partially-etched regions 602 that are exposed from the respective patterned photoresist layer 71 (see FIGS. 11 and 13). Each of the breaking-line-defining protrusions 7122 is spaced apart from a respective one of the chip-defining parts 7123 by a gap 713. The gaps 713 which are defined by the breaking-line-defining protrusions 7122 and the chip-defining parts 7123 are respectively aligned with the to-be-partially-etched regions 602 so as to expose the to-be-partially-etched regions 602 therefrom. Since the to-be-partially-etched regions 602 have a width (D2) in the first direction that is significantly less than a width (D1) of the to-be-fully-etched regions 601 in the second direction (Y), the to-be-partially-etched regions 602 have an etching rate lower than that of the to-be-fully-etched regions 601.

As mentioned above, the patterned photoresist layers 71 formed on the top and bottom surfaces 603, 604 are symmetrical to each other, so that the to-be-partially-etched regions 602 and the to-be-fully-etched regions 601 of the top surface 603 are symmetrical to the to-be-partially-etched regions 602 and the to-be-fully-etched regions 601 of the bottom surface 604.

As shown in FIG. 14, in step S2, the etched portion 600 is etched by chemical etching or sandblasting so as to pattern the magnetic wafer 60. In detail, the to-be-partially-etched regions 602 and the to-be-fully-etched regions 601 of the top and bottom surfaces 603, 604 of the magnetic wafer 60 are simultaneously etched, such that the magnetic wafer 60 is patterned so as to form a magnetic patterned wafer 61.

Figure 15:
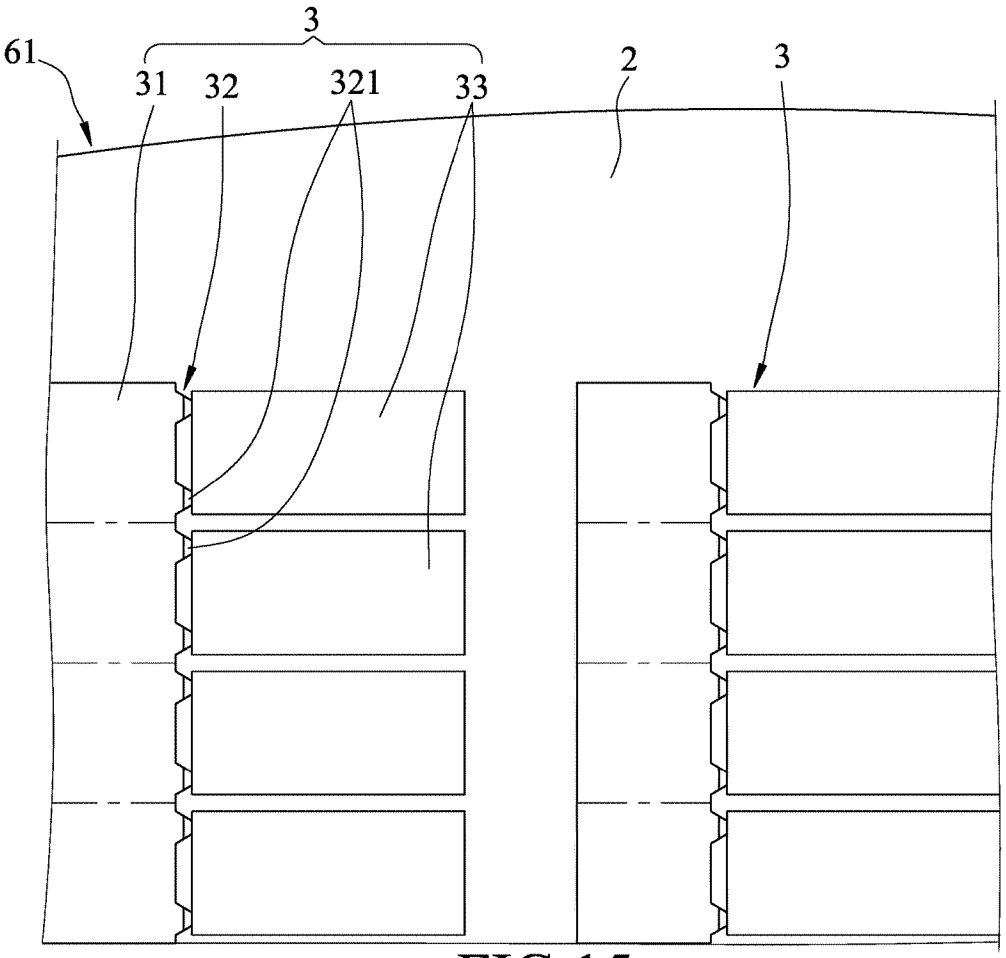
FIG. 15 is a fragmentary top view illustrating step S3 of the method of magnetic patterned wafer according to the disclosure.

In step S3 (see FIG. 15), the patterned photoresist layers 71 are removed from the magnetic patterned wafer 61. The magnetic patterned wafer 61 has a peripheral end portion 2 and at least one core chip unit 3 that includes a connecting portion 31, a breaking line 32, and a plurality of spaced apart chip bodies 33. The connecting portion 31 is connected to the peripheral end portion 2. The breaking line 32 has a plurality of connecting tabs 321 that are spaced apart from one another. Each of the connecting tabs 321 is disposed between and interconnects the connecting portion 31 and a respective one of the chip bodies 33. In this embodiment, two of the connecting tabs 321 interconnect the connecting portion 31 and the corresponding one of the chip bodies 33. In this embodiment, the passive-component unit 3 has a structure similar to that shown in FIG. 6.

The shape of the connecting tabs 321 thus formed can be controlled based on actual requirements by varying the shape of the breaking-line-defining protrusions 7122. In one embodiment, referring back to FIG. 13, each of the breaking-line-defining protrusions 7122 has a first end 7124 connected to the connecting part 7121 and a second end 7125 disposed adjacent to the respective one of the chip-defining parts 7123 and opposite to the first end 7124 in the first direction (X), and is reduced in width (D3) along the first direction (X) from the first end 7124 toward the second end 7125.

Figure 16:
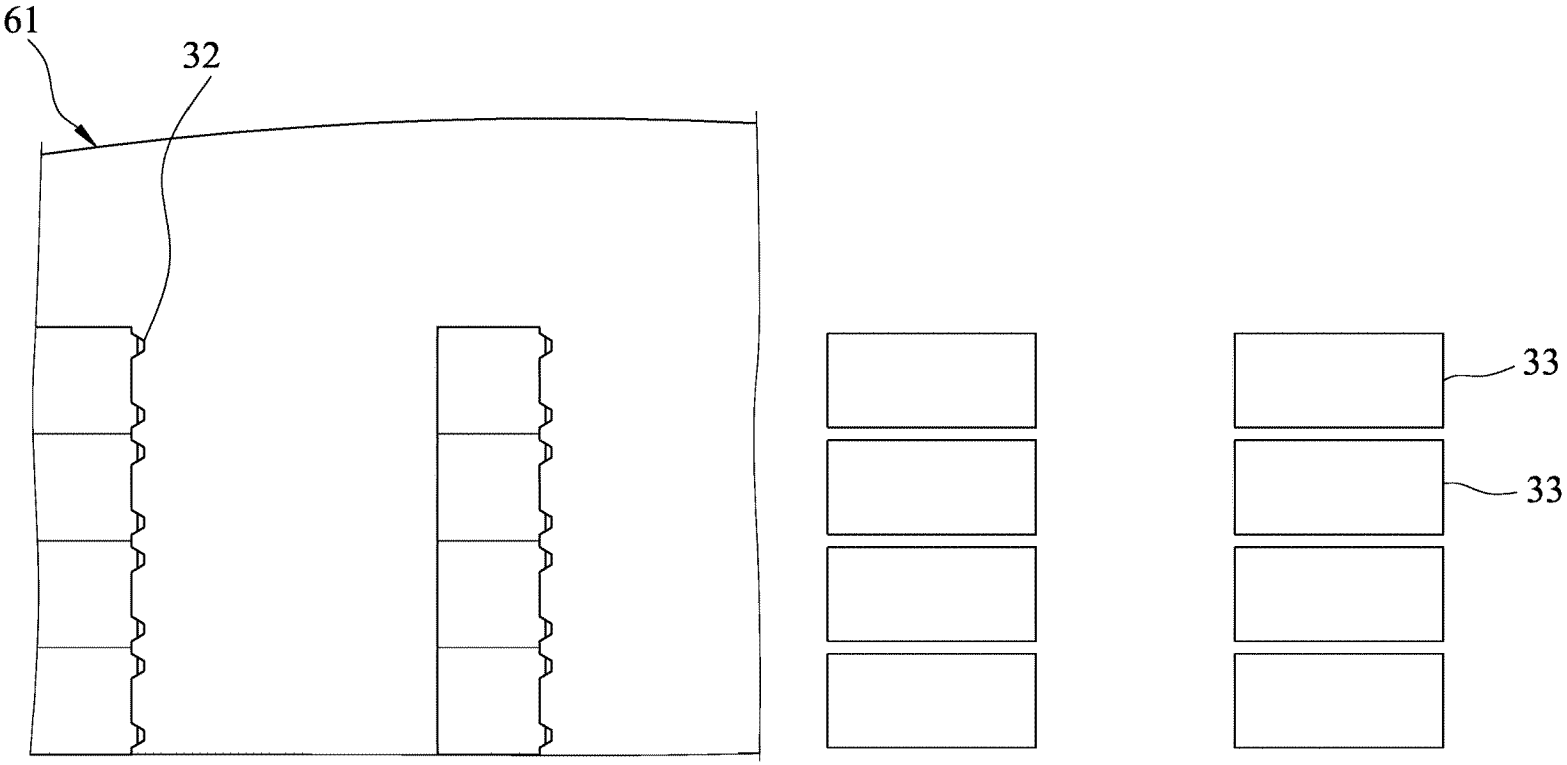
FIG. 16 is a fragmentary top view illustrating step S4 of the method of magnetic patterned wafer according to the disclosure.

In step S4 (see FIG. 16), the magnetic patterned wafer 61 is broken along the breaking line 32 by applying an external force thereto so as to separate the chip bodies 33 from the connecting portion 31. Alternatively, the patterned wafer 61 may be broken along the breaking line 32 using a scriber (not shown) or using etching techniques.

As mentioned above, the magnetic patterned wafer is made from the magnetic metal material or the magnetic ceramic material. The method may further comprises forming a metallic protective layer (not shown) on the wafer before formation of the patterned photoresist layer 71, and the patterned photoresist layer 71 is formed on the metallic protective layer.

The following description illustrates another method of making a magnetic patterned wafer of the embodiment of the disclosure, and should not be construed as limiting the scope of the disclosure. The method includes the steps of s1 to s4.

Figure 17:
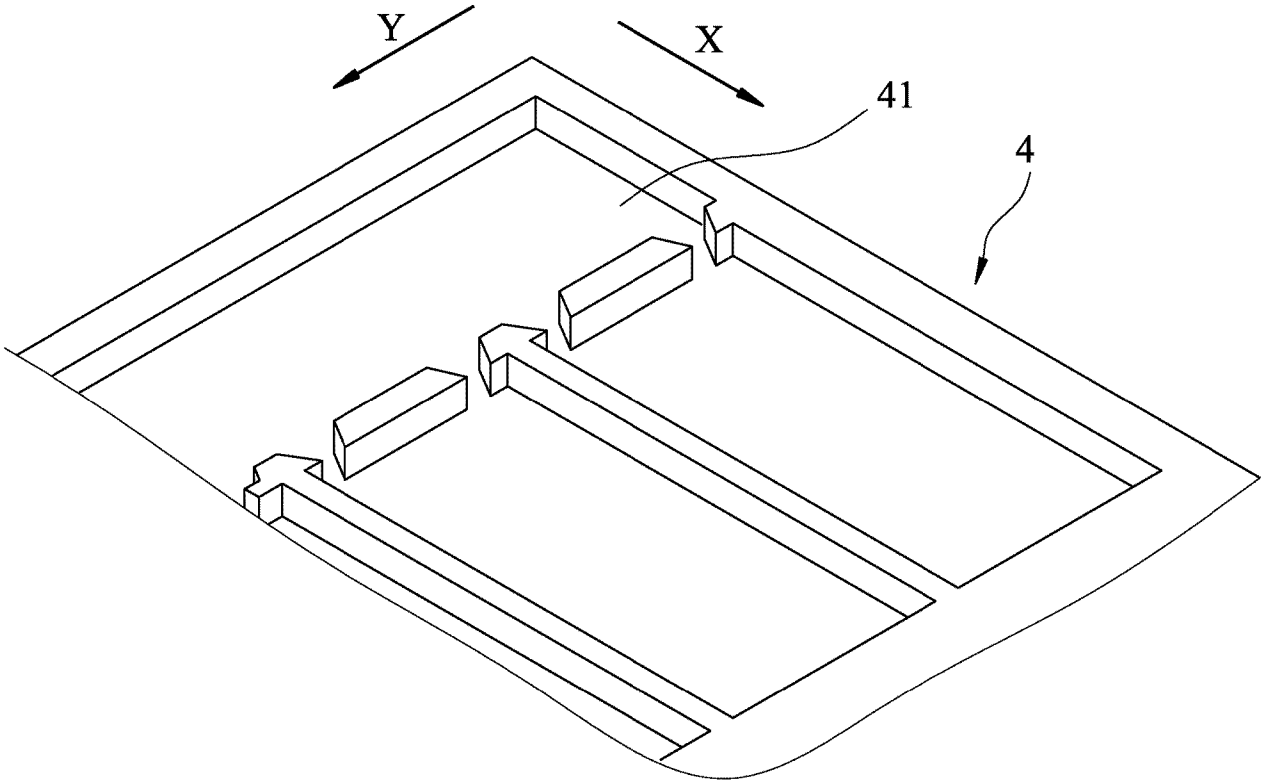
FIG. 17 is a fragmentary top view illustrating a punching die used in step s1 of a method of making a magnetic-core-inductor-patterned wafer according to the disclosure.

In step s1 (see FIG. 17), a punching die 4 having a plurality of die holes 41 that are arranged in an array is provided.

Figure 18:
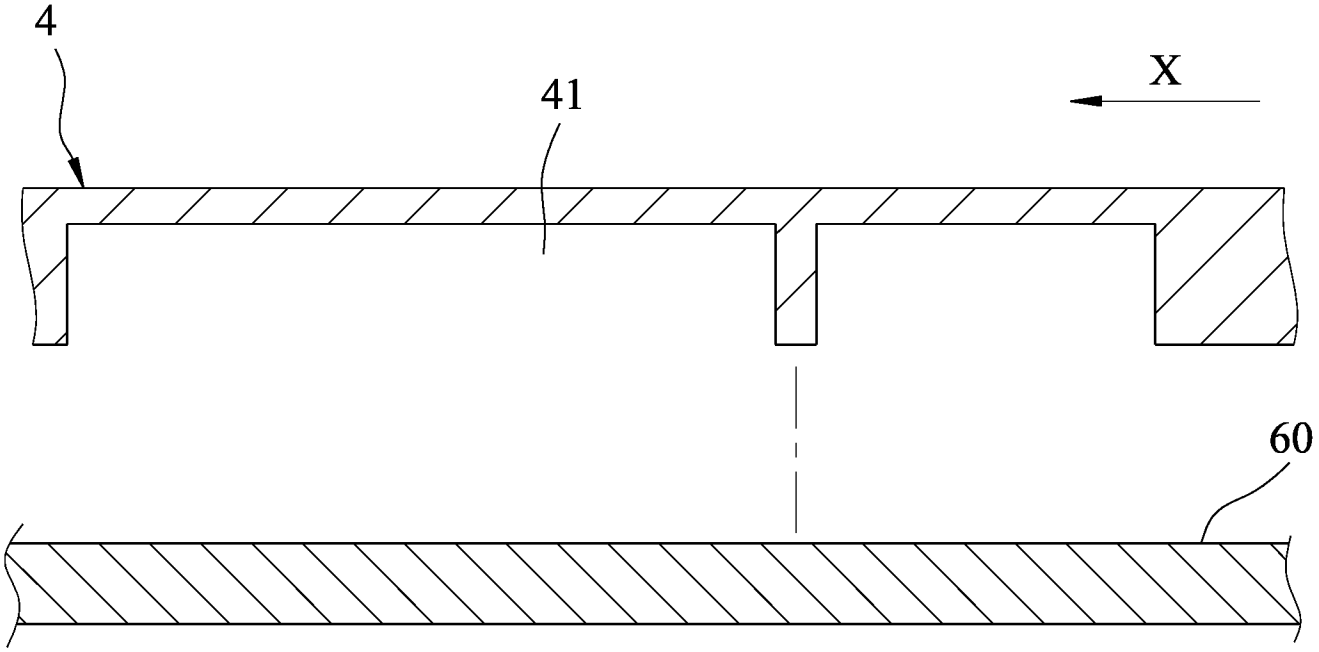
FIGS. 18 and 19 are sectional views illustrating step s2 of the method of making a magnetic-core-inductor-patterned wafer according to the disclosure.
Figure 19:
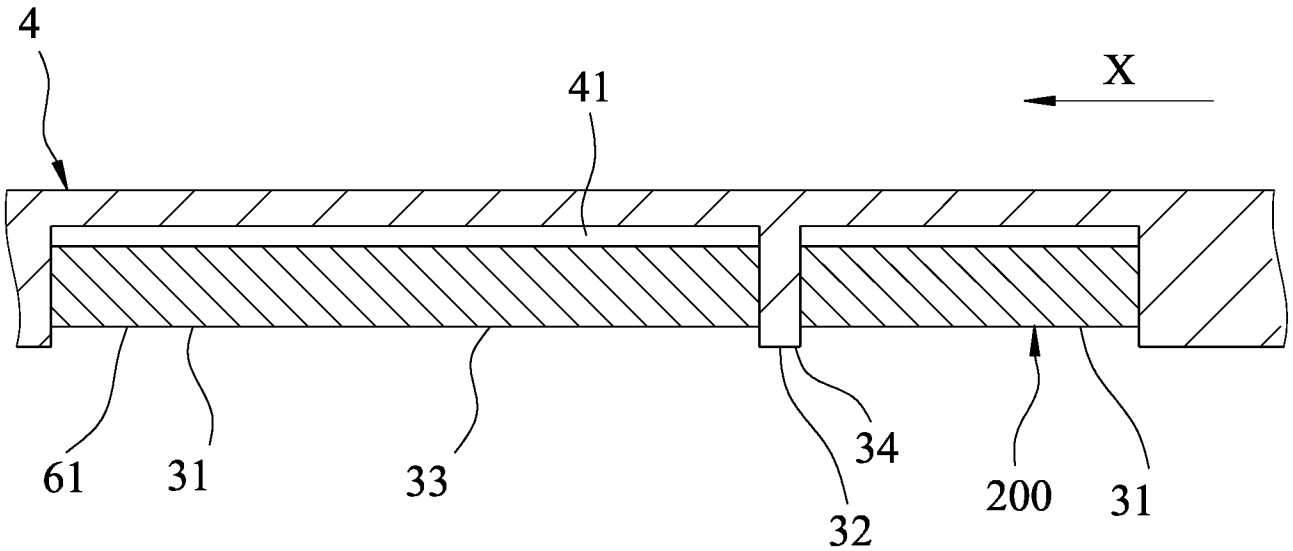

In step s2 (see FIGS. 18 and 19), a magnetic wafer 60 is punched using the punching die 4 so as to form a magnetic patterned wafer 61 that has a peripheral end portion (not shown) and at least one core chip unit 3, the core chip unit 3 including a connecting portion 31, a breaking line 32, and a plurality of spaced apart chip bodies 33. The connecting portion 31 is connected to the peripheral end portion (not shown), and is spaced apart from the chip bodies 33 by a tab-accommodating space (not shown) along a first direction (X). Similar to the structure shown in FIG. 5, the breaking line 32 has a plurality of connecting tabs 321 that are spaced apart from one another and that are disposed in the tab-accommodating space 34. Each of the connecting tabs 321 interconnects the connecting portion 31 and a respective one of the chip bodies 33. In this embodiment, two of the connecting tabs 321 interconnect the connecting portion 31 and the corresponding one of the chip bodies 33.

In certain embodiments, the magnetic wafer 60 is made from a magnetic metal material or a magnetic ceramic green, and the method further comprises sintering the chip bodies 33 after the chip bodies 33 are separated from the connecting portion 31.

In summary, the methods of the present disclosure may be advantageous over the prior art in reducing the steps of making the magnetic patterned wafer.

Furthermore, the core chip unit 3 of the magnetic patterned wafer 61 of the present disclosure is in the form of a single piece. As such, the core chip unit 3 of the magnetic patterned wafer of the present disclosure has a higher mechanical strength than that of the conventional multilayered type inductor.

While the present disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A method of making a magnetic patterned wafer that is used for production of magnetic-core-inductor chip bodies, comprising:

forming at least one patterned photoresist layer on a magnetic wafer such that the magnetic wafer has an etched portion exposed from the patterned photoresist layer, the patterned photoresist layer having a peripheral end part and at least one core-defining unit, the core-defining unit having a connecting part, a plurality of breaking-line-defining protrusions, and a plurality of chip-defining parts;

etching the etched portion to pattern the magnetic wafer to form the magnetic patterned wafer; and removing the patterned photoresist layer from the magnetic patterned wafer, such that the patterned magnetic wafer has a peripheral end portion and at least one core-defining unit that includes a connecting portion, a breaking line, and a plurality of spaced apart chip bodies, the connecting portion being connected to the peripheral end portion, the breaking line having a plurality of connecting tabs that are spaced apart from one another, each of the connecting tabs being disposed between and interconnecting the connecting portion and a respective one of the chip bodies.

2. The method of claim 1, wherein each of the breaking-line-defining protrusions is aligned with a respective one of the chip-defining parts in a first direction and having a width smaller than that of the respective one of the chip-defining parts in a second direction that is perpendicular to the first direction.

3. The method of claim 1, wherein the magnetic wafer has top and bottom surfaces, each of which is formed with the patterned photoresist layer, the patterned photoresist layers formed on the top and bottom surfaces being symmetrical to each other.

4. The method of claim 1, further comprising breaking the patterned wafer along the breaking line so as to separate the chip bodies from the connecting portion.

5. The method of claim 1, wherein the magnetic wafer is made from a magnetic metal material or a magnetic ceramic material.

6. The method of claim 1, wherein etching of the etched portion is performed by chemical etching or sandblasting.

7. The method of claim 6, wherein the etched portion of the magnetic wafer has a plurality of to-be-fully-etched regions and a plurality of to-be-partially-etched regions, each of the breaking-line-defining protrusions being spaced apart from the respective one of the chip-defining parts by a gap, the gaps defined by the breaking-line-defining protrusions and the chip-defining parts being aligned with the to-be-partially-etched regions so as to expose the to-be-partially-etched regions therefrom, each of the to-be-partially-etched region having an etching rate lower than that of each of the to-be-fully-etched region.

8. The method of claim 7, wherein the magnetic wafer has top and bottom surfaces, each of which is formed with the patterned photoresist layer, the patterned photoresist layers formed on the top and bottom surfaces being symmetrical to each other, the to-be-partially-etched regions and the to-be-fully-etched regions of each of the patterned photoresist layers being simultaneously etched.

9. The method of claim 7, wherein each of the breaking-line-defining protrusions has a first end connected to the connecting part and a second end disposed adjacent to the respective one of the chip-defining parts and opposite to the first end in a first direction, and is reduced in width along the first direction from the first end toward the second end.

* * * * *